US009922501B2

(12) United States Patent
Malt

(10) Patent No.: US 9,922,501 B2
(45) Date of Patent: Mar. 20, 2018

(54) COMMUNITY AWARD DISTRIBUTION SYSTEM

(75) Inventor: Paul Robert Malt, Nottingham (GB)

(73) Assignee: Novomatic AG, Gumpoldskirchen (AT)

( * ) Notice: Subject to any disclaimer, the term of this patent is extended or adjusted under 35 U.S.C. 154(b) by 50 days.

(21) Appl. No.: 13/191,561

(22) Filed: Jul. 27, 2011

(65) Prior Publication Data

US 2012/0028697 A1 Feb. 2, 2012

(30) Foreign Application Priority Data

Jul. 27, 2010 (GB) ..... 1012573.0

(51) Int. Cl.
*G07F 17/32* (2006.01)
*G07F 17/34* (2006.01)

(52) U.S. Cl.
CPC ..... *G07F 17/329* (2013.01); *G07F 17/3244* (2013.01); *G07F 17/3269* (2013.01); *G07F 17/3272* (2013.01); *G07F 17/34* (2013.01)

(58) Field of Classification Search
USPC ..... 463/20
See application file for complete search history.

(56) References Cited

U.S. PATENT DOCUMENTS

2003/0073480 A1* 4/2003 Thomas ..... G07F 17/32 463/18
2003/0073494 A1* 4/2003 Kalpakian ..... G07F 17/32 463/42
2006/0073897 A1 4/2006 Englman et al.
2007/0060247 A1* 3/2007 Low ..... G07F 17/32 463/16
2007/0060302 A1* 3/2007 Fabbri ..... G07F 17/323 463/24
2007/0060320 A1* 3/2007 Kelly et al. ..... 463/27
2007/0060370 A1* 3/2007 Ueda ..... G07F 17/32 463/42
2007/0184896 A1 8/2007 Dickerson
2007/0243928 A1* 10/2007 Iddings ..... G07F 17/32 463/26
2009/0042641 A1* 2/2009 Anderson ..... G07F 17/3269 463/25
2009/0124385 A1* 5/2009 Cuddy et al. ..... 463/42
2009/0275410 A1 11/2009 Kisenwether et al.
2010/0120494 A1* 5/2010 DeWaal et al. ..... 463/20
2011/0034241 A1* 2/2011 Englman et al. ..... 463/27
2011/0130191 A1* 6/2011 Englman ..... G07F 17/32 463/20
2012/0034968 A1 2/2012 Watkins et al.
2012/0184353 A1* 7/2012 Anderson ..... G07F 17/32 463/25

FOREIGN PATENT DOCUMENTS

GB 2405736 A 3/2005
WO 2007030552 A2 3/2007
WO 2009/061386 A1 5/2009

* cited by examiner

*Primary Examiner* — Milap Shah
*Assistant Examiner* — Robert T Clarke, Jr.
(74) *Attorney, Agent, or Firm* — Fox Rothschild LLP

(57) ABSTRACT

Disclosed are community award distribution systems and related methods, which are arranged to control an award made to a user playing the systems. Also disclosed, the community award systems are arranged to communicate over the Internet and/or make use of the World Wide Web.

16 Claims, 3 Drawing Sheets

COMMUNITY AWARD DISTRIBUTION SYSTEM

CROSS REFERENCE TO RELATED APPLICATIONS

This application claims priority to GB Application No. 1012573.0 filed on Jul. 27, 2010.

FIELD OF INVENTION

This invention relates to a community award distribution system and related methods. In particular, the invention may relate to a community gaming system which is arranged to control an award made to each user playing the system and related methods. In particular, but not exclusively, the community award system is arranged to communicate over the Internet and/or make use of the World Wide Web.

BACKGROUND OF INVENTION

It is known to provide award distribution systems which users can access across network connections, which are typically Internet based, and have awards paid out therefrom dependent upon the users performance. Often such award distribution systems are referred to as community systems.

Traditional non-network award terminals provide complex schemes to determine whether or not an award should be made to a user. As a starting point, a skilled person would assume that to provide a networked game would simply require re-creating the functionality of a non-networked award terminal across a network. However, to support the functionality of such a non-networked award terminal would impart a severe burden on the network requiring significant communication between a networked terminal and a server(s) monitoring and/or controlling awards being distributed by the networked system. As such, significant technical issues are placed upon the networked infrastructure.

SUMMARY OF INVENTION

According to a first aspect of the invention there is provided a community award distribution system. The system may comprise at least one server arranged to communicate over a network with a community of terminals and provide an award scheme. The award scheme may pay an award to be distributed between users of the community of terminals and the server may be arranged to monitor the number of users using the community of terminals and control the award scheme. In one embodiment, the server may control the terminals so that they provide an award to the users at, on average, a fixed and predetermined time period. In other embodiments, the system may be arranged to provide the award on a randomly occurring basis, where the long term resultant average time between such awards is a predetermined time period.

An advantage of such a system is that it that it significantly reduces the amount of network traffic that is needed to run the award system. The server(s) do not need to continuously monitor the community of terminals and as such the need for extensive network communication is removed.

The skilled person will appreciate that the server conveniently comprises a timer arranged to monitor time and ensure that on average an award is made to the users of the community at the fixed and predetermined time period.

Conveniently, the system is arranged such that the number of users does not affect the fixed predetermined time.

In one embodiment, the server is arranged to provide an award determining mechanism which is used to determine whether an award should be made. In one embodiment, the award determining mechanism comprises set of reels (which may be physical and/or a simulation thereof).

In other embodiments the award determining mechanism may comprise other mechanisms such as roulette wheels, dice, a deck of cards or the like.

In one particular embodiment, the server comprises a plurality of award determining mechanisms. Further, the server may be arranged to switch between award determining mechanisms in order to control whether or not an award should be made to the community of users; ie whether or not to provide a community feature game. For example, the plurality of award determining mechanisms may comprise a plurality of sets of reels each of which contains a distinct set of symbols thereon.

Potential advantages of embodiments of the system may be as follows:

- The number of users (ie community members) of the system is scalable from 1 user to an unlimited number of users.
- The Return To Player (RTP) of an individual users basic/community is not adversely affected by other users entering or exiting the community, or other user's speed of play, or other user's level of wagering etc.
- Community feature is triggered as a chance event reel combination from an eligible user.
- Community feature frequency is unaffected by the number of users in the community, and their speed of play.
- The theoretical frequency of the community feature is on average a fixed period. In one embodiment, the fixed predetermined period is roughly every 800.95 seconds. However, other embodiments may used other fixed predetermined periods. For example, the fixed predetermined period may be roughly any of the following: 50, 100, 200, 300, 400, 500, 600, 700, 900, 1000, or more seconds. This is a random event so is subject to wide variation. However, the skilled person will appreciate that over a period the average will approach this fixed and predetermined time.
- The global award multiplier from the community feature is entirely random with no adaptive behaviour. Therefore, the game does not maintain a pot for user contributions from total bet.
- The system employs no adaptive behaviour based upon previous outcomes so ensuring the games legal compliance in various jurisdictions.

In some embodiments, the system is arranged such that each terminal within the community of terminals is arranged to provide a display presenting the award scheme provided by the server. The award scheme is typically arranged to be played by a user from time to time in a relatively short period. Wherein in this context, relatively short is on the order of seconds and is perhaps roughly any of the following: 1, 2, 3, 4, 5, 6, 7, 8, 9, 10, 15, 20 or 30 seconds.

Each terminal may be arranged to maintain an eligibility time which is incremented each time a user plays a new game and is subsequently decremented with the passage of time. As such, an incentive is provided to a user to keep playing the award scheme in so far as that if the period between his/her plays is slower than the amount of time given to him/her when they play a new game then his/her eligibility timer will not increase. A pointer may be provided which indicates the value of a user's eligibility timer.

The user's eligibility timer may be used as a multiplier to help determine an award made to a user.

Each terminal may be arranged, when a user plays a new game, to send a data packet to the server. Such data packet may contain a time stamp indicating when the start of that game occurred.

In response to the data packet sent from the terminal the server may return a reply data packet containing at least one of the following, and in some embodiments all of the following: the position to which the award determining mechanism should be moved; the result of that game; the status of the credit of the user; and the value of the eligibility timer for that user. In such an embodiment, it will be seen that the game is provided by the server and the terminal is used to display the outcome to the user.

The eligibility time may be used to determine whether a user is eligible to participate in a community feature game, any award from which is distributed amongst any user of an eligible terminal. The server may be arranged to send at least one data packet to eligible terminals within the community when a community game is started.

In other embodiments, the server may be arranged to trigger a community feature game as part of reply data packet, to the player request packet. As such, the server is arranged to only respond to requests from a client, rather than the server starting a communication with a client.

The terminal may also be arranged to interrogate the server from time to time, which may be periodically (i.e. 6 seconds) to check if a community feature is pending. This interrogation of the server may only occur following inactivity from the user, after 6 seconds.

A community game may be started by a predetermined occurrence on the award determining mechanism. It will be appreciated that the server may control whether or not a community feature game is provided by utilising which award determining mechanism is used.

It will be appreciated that despite the community nature of the award scheme (ie that an award can be shared between a plurality of users) there is no need to have extensive communications across the network between each of the users of the community. The use of the timer and/or plurality of award determining mechanisms which can be selected provides technical means which solve the problem of having extensive network communication to ensure that the community award scheme is synchronised.

Conveniently, the community of terminals comprises a plurality of terminals, but the skilled person will appreciate that the community can include a single terminal.

According to a second aspect of the invention there is provided a method of providing a community award comprising providing a server which communicates over a network with a community of terminals and provides an award scheme thereto such that the award scheme is distributed between users of the community of terminals, wherein the server monitors the number of users using the community of terminals and controls the award scheme to that it provides an award to the users at, on average, a fixed and predetermined time period.

According to a third aspect of the invention there is provided a server comprising a timer and a plurality of award determining mechanisms and being arranged to communicate with a plurality of terminals, in use, the server being arranged to provide an award to be shard between users of the terminals at, on average, a fixed predetermined time, the server being arranged to receive a communication from any one of the terminals indicating that a game has been started on that terminal and to respond with a reply data packet indicating the outcome of that game.

Typically, the server is arranged to control the award determining mechanism in order that an award is paid to the community of users at, on average, the predetermined fixed period.

Typically the period is provided on a random basis and as such there may be variation between the times at which the server determines an award should be shared between the community of users.

According to a further aspect of the invention there is provided a community award distribution system comprising at least one server arranged to communicate over a network with a community of terminals and provide an award scheme to be distributed between users of the community of terminals.

In the above aspects reference is made to an award scheme. Such an award scheme may be provided by what is commonly termed a game and as such the phrase award scheme may be replaced with the phrase game.

There may be provided a machine readable medium containing instructions which when read by a machine cause that machine to perform the method of, or function as the hardware of any of the above aspects of the invention.

In any of the above aspects of the invention the machine readable medium may comprise any of the following: a floppy disk, a CD ROM, a DVD ROM/RAM (including a –R/–RW and +R/+RW), a hard drive, a memory (including a USB memory key, an SD card, a Memorystick™, a compact flash card, or the like), a tape, any other form of magneto optical storage, a transmitted signal (including an Internet download, an FTP transfer, etc), a wire, or any other suitable medium.

Further, the skilled person will appreciate that a feature of any one of the above aspects of the invention may be applied, mutatis mutandis, to any of the other features of the invention.

BRIEF DESCRIPTION OF DRAWINGS

There now follows by way of example only a detailed description of an embodiment of the present invention with reference to the accompanying drawings in which.

DETAILED DESCRIPTION OF DRAWINGS

The community award distribution system (CADS) 100 comprises a network 102, which in this embodiment is provided by the Internet and World Wide Web (WWW). However, other embodiments may use other networks.

Figure 1:
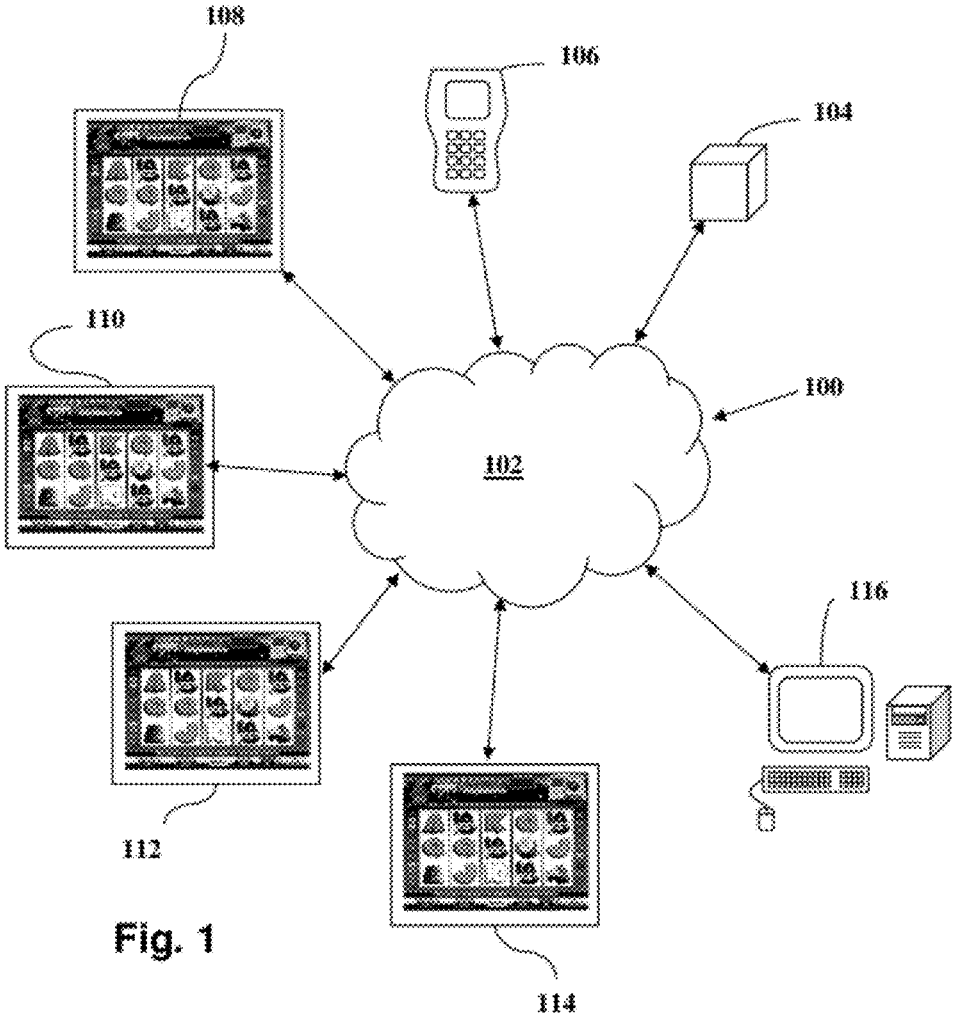
FIG. 1 exemplifies a network providing an embodiment of a community award distribution system.

The CADS 100 comprises a server 104 which monitors a number of terminals 106-116 (which may be thought of as a community of terminals) to provide a community award scheme to the users of the those terminals. The figures shows that the terminals may be any number of devices capable of communicating across the network 102 with the server 104 and the Figure exemplifies a mobile telephone 106 and a Personal Computer 116, such as a MAC™, a PC or the like. However, the terminals 104-114 may be any other suitable form of device such as a PDA (Personal Digital Assistant), a Television, a games console (such as a Playstation™, XBox™ etc.), an iPad™, etc. Indeed, it will be seen that FIG. 1 shows generic screens for terminals 108, 110, 112, 114 which may be any such device.

Figure 2:
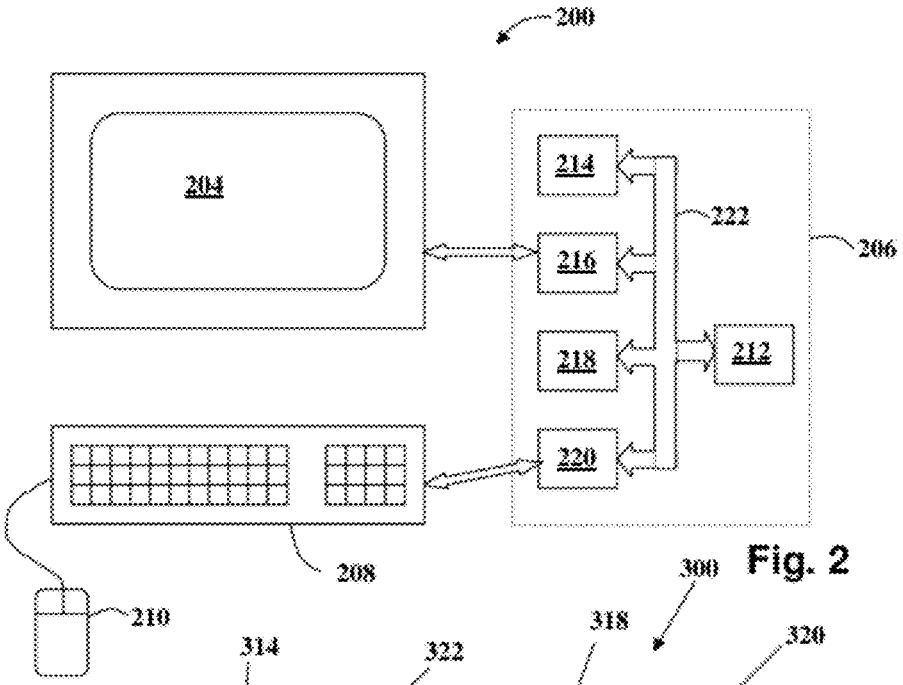
FIG. 2 exemplifies a typical system suitable for providing at least aspects of the network described with reference to FIG. 1.

In one embodiment, the server 200, comprises a display 204, processing circuitry 206, a keyboard 208, and mouse 210. The processing circuitry 206 further comprises a processing unit 212, a hard drive 214, a video driver 216, memory 218 (RAM and ROM) and an I/O subsystem 220 which all communicate with one another, as is known in the art, via a system bus 222. The processing unit 212 comprises an INTEL PENTIUM series processor. The terminals 106-116 may have similar components, mutatis mutandis, to those shown as the server in FIG. 2.

As is known in the art the ROM portion of the memory 218 contains the Basic Input Output System (BIOS) that controls basic hardware functionality. The RAM portion of memory 218 is a volatile memory used to hold instructions that are being executed, such as program code, etc. The hard drive 214 is used as mass storage for programs and other data and would typically be provided as a Redundant Array of Inexpensive Discs (RAID).

Other devices such as CDROMS, DVD ROMS, network cards, etc. could be coupled to the system bus 222 and allow for storage of data, communication with other computers over a network, etc.

The server 200 could have the architecture known as a PC, originally based on the IBM specification, but could equally have other architectures. The server could may be an APPLE, or may be a RISC system, and may run a variety of operating systems (perhaps HP-UX, LINUX, UNIX, MICROSOFT NT, AIX™, OSX, Apache or the like).

Figure 3:
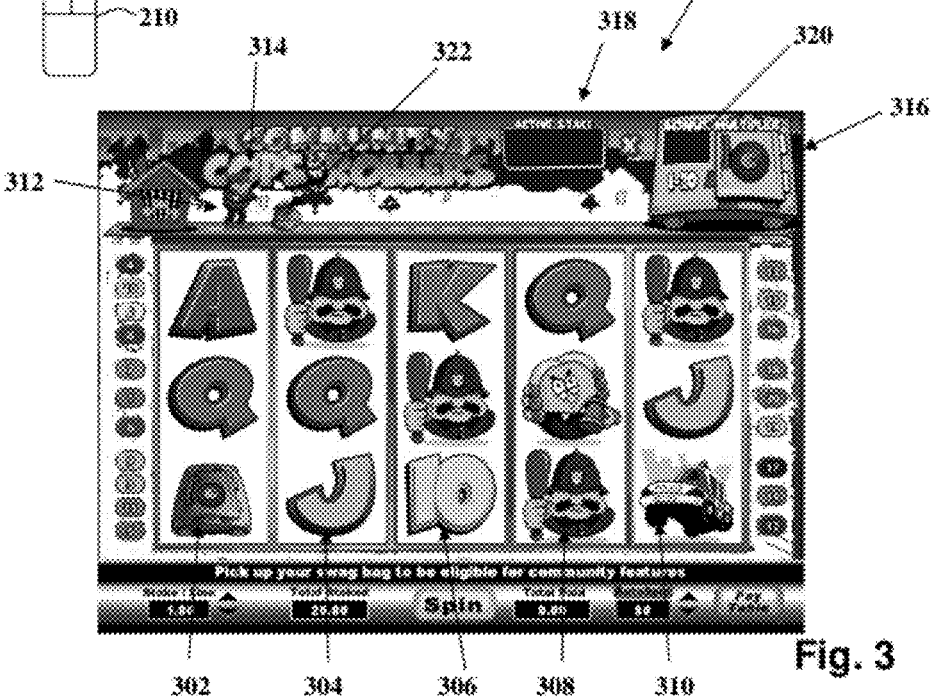
FIG. 3 shows an example screen shot from an embodiment of the idea.

FIG. 3 shows an enlargement 300 of the screen shots on the terminals 108, 110, 112, 114 shown in FIG. 1 and comprises 5 reels 302, 304, 306, 308, 310 together with a community award eligibility display region CAEDR (312) along a top region of the screen shot 300. The reels may be thought of as an award determining mechanism used by the server 104 to determine whether an award should be made to a user and/or the community of users.

When a user wishes to participate in the community award distribution system he/she uses his/her terminal (eg 106-116) to contact the server 104. The skilled person will appreciate that there may well be a plurality of servers which communicate with the network 102 and a user may communicate with any of these or indeed more than one server. When the user's terminal 106-116 contacts the server 104 the server responds by downloading content onto the terminal sufficient for that terminal to provide the display to the user thereof (eg the screenshot 300 shown in FIG. 3). In the embodiment being described the community award distribution system is provided by FLASH™ but may, in other embodiments, be provided by other technology such as HTML (Hyper Text Markup Language) version 5.

However, the Community Award Distribution System downloaded to the terminal (eg 106-116) thereafter provides the system to a user thereof and is arranged to reduce the amount of ongoing communication between the terminal 106-116 and the server 104.

Being a community game, the server 104 is arranged to provide an award to each user which is using the CADS 100 when the server 104 determines that an award should be made. As such, despite trying to reduce network ongoing network communication the server 104 is also arranged to control the CADS 104 in order that the award paid to the community does not become excessive despite being provided in a random environment; if the awards become too large then the provider of the CADS 100 may not be able to fulfil that award.

To this end the CAEDR (312) at the top region of the display 300 is used to display whether a user is eligible for a community award.

The CAEDR (312) in the CADS 100 is depicted above as a Cop chasing a Robber 314 along a top region of the screen 300. The maximum eligible time (ATA_CAP_MAX) is 66 seconds and is represented by the Robber 314 advancing to the far right of the screen 300 adjacent what is depicted in this embodiment as a safe 316. The Cop is always to the far left of the screen and so appears to be running on the spot.

In the embodiment being described when a user makes an input to the CADS 100 (ie plays another game), the position of the Robber 314 advances forward (very quickly) 6 seconds with the start of a game played. As such, the CAEDR 312 provides a timeline along which a pointer (ie the Robber 314) is moved. However, the position of the Robber is also continuously moving backwards by a distance of 1 second, for every 1 second elapsed. Therefore, if the user is playing at a rate of 1 game every 6 seconds, the Robber will appear to move only slightly forwards and backwards about the same position. If played at a faster rate of 4 seconds per game the Robber will move forward 6 seconds and drop back 4 seconds, and so steadily advance forward at an average rate of 2 seconds per game. If the speed of play slows to greater than 6 seconds per game the Robber will approach the left side of the screen and will ultimately be caught up by the Cop.

In the embodiment being described, when a user plays another game on his/her terminal a data packet is sent to the server 104. This data packet is time stamped in order that the server 104 identifies the time at which the game was started. The terminal 106-116 also sends to the server 104 any one or more of the following: the stake, the stake per line and the selected win lines.

The terminal also had recorded thereon, a cookie which is used to identify that terminal 106-116 to the server 104.

In response, the server 104 returns a reply data packet to the terminal that sent the request (which of course may be a plurality of data packets). The reply data packet contains the results of that game which the Flash™ client on the terminal then displays. The server reply contains the reel positions to which the reels 302-310 should be moved, whether or not the game has resulted in a win, the status of that user's credit (ie account balance) and confirmation of the value of the Eligibility Timer (ET)—which is reflected by the position of the robber 314—which is subsequently synchronised with a local timer on the terminal 106-116.

Figure 4A:
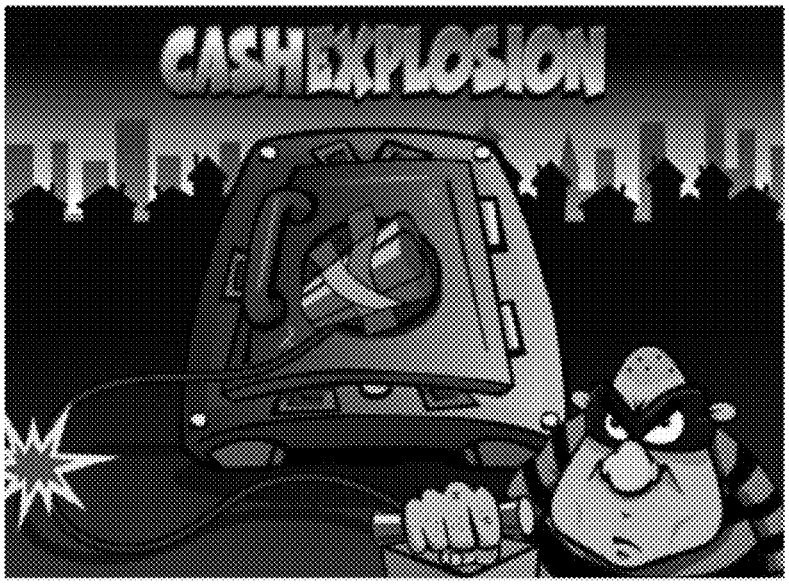
FIG. 4*a* shows a first screen from an example of a community feature game that may be provided by embodiments.
Figure 4B:
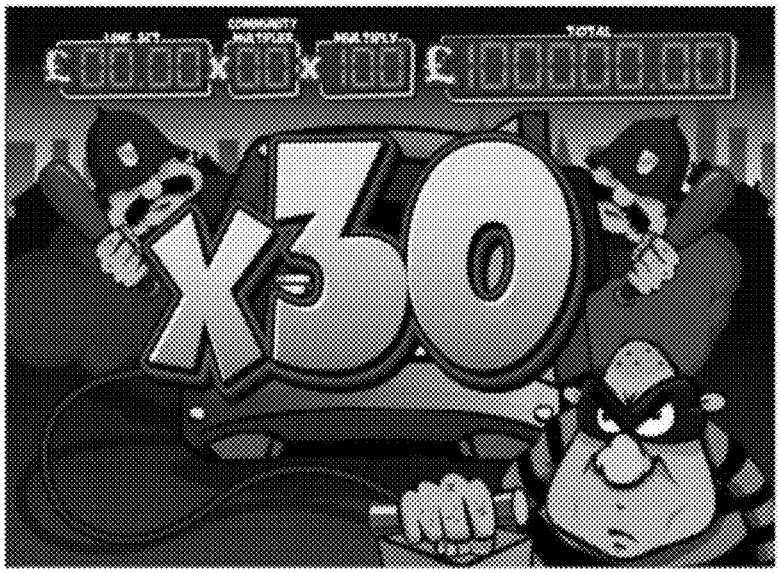
FIG. 4*b* shows a second screen from an example of a community feature game that may be provided by embodiments.

Also, the reply data packet contains details of whether a community game feature has been triggered (as exemplified in FIGS. 4*a* and 4*b*).

Should a player be eligible to play a community feature game (ie his/her ET>6) then he/she is also sent a string of states-per-second) so that the terminal may move the user to the correct stake after using up his/her earned time.

In such circumstances, the server 104 about a community queue which contains information about the community feature game for which that user is eligible.

This data also contains information such as the feature level (3, 4 or 5 symbols in view), the stake and multiplier values that were being used by the player when this feature was triggered, and the timestamp of exactly when the feature was triggered. The timestamp matches the one sent to all players who were eligible for this particular feature. It is then used to seed a random number generator which ensures all players will see the same in-feature results by picking the same random numbers as every other player.

When users become eligible for the community feature, his/her stake value is recorded for each second of eligibility they now possess. This string of stakes-per-second is sent to the game so that the game can move the player to the right stake value after using up their earned seconds.

The top region of the screen 300 also comprises an ACTIVE STAKE meter 318, which is also referred to in this document as Community Stake (CS), which is the bet per line, with reference to Eligibility Time which is maintained by the terminal 106-116 being used by a user. However, in the embodiment being described, it is noted that the server 104 additionally maintains a master copy of the timer, that being maintained by the terminal 106-116 being a local copy. The local copy is synchronised with the timer on the server 104 using the reply data packet sent from the server 104 to the terminal 106-116. At least one advantage of the local timer is that it allows the CAEDR 312 to be maintained irrespective of whether a user is staring new games on the terminal 106-116. This synchronisation from time to time (as opposed to continuous communication) also helps to reduce network traffic.

The Bonus Multiplier 320 (BM) (displayed as a portion of the safe 316) increases from ×1 to ×20 in a linear proportion to the Eligibility Timer over the range 1 to 60 seconds. The Bonus Multiplier 320 further increases from ×20 to ×45 in response to the Eligibility Timer being capped at a maximum of 66 seconds. The Additional Time Added (ATA) to the Eligibility Timer for each game played is typically 6 seconds. However, due to the Eligibility Timer being capped at a maximum of 66 seconds, ATA can drop to 3 seconds, which is reflected by a higher BM 320. The capping of the Eligibility Timer is graduated from 61 to 66 seconds with progressively more seconds being capped, and a progressively higher average BM 320 to maintain a constant percentage theoretical Return To Player. This graduation to the capping of Eligibility Timer is done to provide a more graduated change in the BM, for aesthetic reasons.

On CADS 100 the eligibility to the community feature is depicted graphically as a swag-bag 322 (to the left of the screen 300) which is part of the CAEDR (312), where the Robber 314 advances to just past the 6 second position where he picks up the swag-bag 322 (signifying his eligibility to the community award). The Robber 314 keeps hold of the swag-bag 322 until caught by the Cop, whereupon the swag-bag 322 is dropped and returned to the 6 second position. The Robber must then again advance to just past the 6 second position to pick-up the swag-bag 322 to be eligible again.

Imagine the Eligibility Timer is a decimal register that is incremented by 6 seconds, at the beginning of each game, and is repeatedly decremented by 1 second at an interval of every 1 second. The user becomes eligible for the community award when the Eligibility Timer is greater than 6 (Eligibility Timer>6). The user remains eligible until Eligibility Timer runs back down to zero. An Eligibility Flag (EF) is used to reflect whether or not a user is eligible for a community award; where the flag is set when Eligibility Timer>6, and the flag is cleared when Eligibility Timer=0.

For example:

1. When the user first logs (the server 104 downloads to the terminal 106-116) in the Eligibility Timer=0.
2. When the first game is played Eligibility Timer is incremented by 6, so Eligibility Timer is now equal to 6.
3. Eligibility Timer is not greater than 6, so at this stage the eligibility flag is not set.
4. When the second game is played Eligibility Timer is again incremented by 6, so if Eligibility Timer was previously greater than zero, it will now be greater than 6, and so the eligibility flag is now set.
5. The eligibility flag remains set until Eligibility Timer runs down to zero, upon where the eligibility flag would then be cleared.

The net result of this process is to limit the average minimum speed of play to less than 6 seconds per game, while remaining eligible for the community feature.

The main advantage of limiting the eligible minimum average speed of play to 6 seconds per game is that it prevents the BM from dropping below ×1 which would require fractional/decimal representation which would tend to increase the computational load to calculate the bonus. Such fraction/decimals would also produce an award of below the minimum unit denomination that would be harder to return to a user or awkward to store for later aggregation with other similar less than unit denomination awards. These problems are particularly the case when the award is a currency award rather than, for example, points.

The community feature is activated randomly by an eligible user in the community (ie a user which has managed to set the eligibility flag EF on his/her terminal) achieving a predetermined feature reel combination. Which for example may be 3, 4, 5 or more symbols in view upon the reels. An Ineligible user which has not set his/her eligibility flag (EF) cannot trigger the community feature.

The community feature is then played out automatically for all users in the community (ie each user with a set eligibility flag). The multiplier award from the community feature will be the same feature for all users in the community. Although, it's also envisaged that the alternative of giving users a non-common award multiplier which is determined for each user individually, on the same random basis, has advantages of preventing the statistical variation in the return to player percentage increasing with the number of eligible users in the community.

The eligibility countdown will remain active throughout the community feature, although this is unlikely to be visible on the feature screen; ie whilst the eligibility timer is decremented there is no display to a user. If the Eligibility Timer expires during the community feature, the user will still be awarded the win from the community feature. However, they would not be eligible for additional community features that may have been activated at the moment the timer expired. For example, it is conceivable that non-eligible could become eligible during a community feature and trigger a subsequent community feature which would then be played by all eligible users when the current community feature has finished.

Conversely, if the Eligibility Timer had not expired at the moment when another community feature is activated, the user would be eligible for an additional feature, which would be held in an individual user queue. Any queued community features will also need to store the associated community multiplier award CMA, and the instantaneous BM and Community Stake CS (from the Eligibility Timer stored information buffer) at the moment the community feature was triggered. The recorded CMA, BM, and CS in the queue will be used when determining the resultant award from each community feature in the queue, as follows:

Community award=CMA×CS×BM

The Community award may be paid in any suitable currency. For example, the community award may be paid in cash (perhaps to an account of the user), credits to be used at a later time, points, or the like.

Any community features held in the queue will be immediately delivered following the current feature, and so on. Hence, the user can not start a new game until the feature queue is emptied. If a community feature occurs before the user initiates the start of a new game, the community feature must be executed first, so preventing users from staking up (ie raising the stake at which they are playing) at the instant the community feature occurs.

Alternative embodiments may halt the eligibility counter counting down (i.e. freeze) for the duration of the community feature.

Additional information is stored with reference to the Eligibility Timer. This information includes the Community Stake (CS) and Bonus Multiplier (BM).

The purpose for storing this information is to enable the game to maintain a constant Return to Player even if the user dynamically changes his/her total bet. An example, scenario could have existed where the user would build up their Eligibility Timer while only committing minimum stake. Then once his/her Eligibility Timer is full they would play 1 more game at a higher stake and then wait while the Eligibility Timer descends in the hope that somebody else triggers the community feature in the time it take the Eligibility Timer to expire, resulting in a much higher payout based upon their last much higher stake amount. As such, the following strategy is employed to mitigate against such tactics on the part of the user.

The Community Stake (CS) display shows the user their current instantaneous stake within the community, which could be different to his/her ordinary stake, dependant upon their previous stake history. The amount displayed in the CS meter is not determined as an average of the previous stake history, but instead is displayed as the actual amount previous staked per line, with reference to the Eligibility Timer (see example below).

For every new game the CS buffer is updated with the current stake between the positions of the old and new Eligibility Timer. Following every second lapsed by the Eligibility Timer, the CS display is updated with the stake information retrieved from the CS buffer. The leftmost column in the above table shows the contents of the Eligibility Timer; ie the time elapsed in the game. The same procedure is also adopted for the BM display, where the BM buffer is updated with the current BM between the positions of the old and new Eligibility Timer. Following every second of time that the Eligibility Timer counts down the BM display is updated with the information retrieved from the BM buffer.

In the example above the GTA (Game Time Average) is always 6 seconds (ATA—Additional Time Added), despite the variation in speed of play. This defines GTA=ATA, except when the Eligibility Timer is being capped. Therefore, if a game is played when Eligibility Timer=56 seconds, Eligibility Timer will increase by ATA (6 seconds) to give 62 seconds. However, Eligibility Timer is capped at 61 seconds when Eligibility Timer is 56. Therefore, 1 second on the Eligibility Timer must be removed. This loss of 1 seconds on the Eligibility Timer is accounted for by calculating GTA=ATA−1=5.

GTA=ATA−(time capped from ET when ET exceeds dynamic_ATA_CAP[ET])

static const int dynamic_ATA_CAP[ATA_CAP_MAX+1]={60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 60, 61, 62, 63, 63, 64, 65, 66, 66, 66, 66, 66};

When the ET is not being capped BM=progressive_bm[ET]

static const int progressive_bm[ATA_CAP_MAX+1]={1, 1, 1, 1, 2, 2, 2, 3, 3, 3, 4, 4, 4, 5, 5, 5, 6, 6, 6, 7, 7, 7, 8, 8, 8, 9, 9, 9, 10, 10, 10, 11, 11, 11, 12, 12, 12, 13, 13, 13, 14, 14, 14, 15, 15, 15, 16, 16, 16, 17, 17, 17, 18, 18, 18, 19, 19, 19, 20, 20, 20, 20, 20, 20, 20, 20, 20};

When the Eligibility Timer is being capped (as determined by the new GTA) the amount of capped time (1, 2, 3 seconds, etc) is used to index the following structured array to access the min and max random range for the BM.

| ET | GTA | stake/line | CS buffer | CS | BM | BM buffer | Action |
|---|---|---|---|---|---|---|---|
| 0 | | | | 0 | | | |
| (0 + 6) = 6 | 6 | 1p | 1, 1, 1, 1, 1, (1) | 1p | 2 | 1, 1, 1, 2, 2, (2) | game 1 |
| 5 | | | 1, 1, 1, 1, (1) | 1p | 2 | 1, 1, 1, 2, (2) | |
| 4 | | | 1, 1, 1, (1) | 1p | 2 | 1, 1, 1, (2) | |
| (3 + 6) = 9 | 6 | 2p | 1, 1, 1, 2, 2, 2, 2, 2, (2) | 2p | 3 | 1, 1, 1, 2, 2, 2, 3, 3, (3) | game 2 |
| 8 | | | 1, 1, 1, 2, 2, 2, 2, (2) | 2p | 3 | 1, 1, 1, 2, 2, 2, 3, (3) | |
| 7 | | | 1, 1, 1, 2, 2, 2, (2) | 2p | 3 | 1, 1, 1, 2, 2, 2, (3) | |
| 6 | | | 1, 1, 1, 2, 2, (2) | 2p | 2 | 1, 1, 1, 2, 2, (2) | |
| (5 + 6) = 11 | 6 | 5p | 1, 1, 1, 2, 2, 5, 5, 5, 5, 5, (5) | 5p | 4 | 1, 1, 1, 2, 2, 2, 3, 3, 3, 4, (4) | game 3 |
| 10 | | | 1, 1, 1, 2, 2, 5, 5, 5, 5, (5) | 5p | 4 | 1, 1, 1, 2, 2, 2, 3, 3, 3, (4) | |
| 9 | | | 1, 1, 1, 2, 2, 5, 5, 5, (5) | 5p | 3 | 1, 1, 1, 2, 2, 2, 3, 3, (3) | |
| 8 | | | 1, 1, 1, 2, 2, 5, 5, (5) | 5p | 3 | 1, 1, 1, 2, 2, 2, 3, (3) | |
| 7 | | | 1, 1, 1, 2, 2, 5, (5) | 5p | 3 | 1, 1, 1, 2, 2, 2, (3) | |
| 6 | | | 1, 1, 1, 2, 2, (5) | 5p | 2 | 1, 1, 1, 2, 2, (2) | |
| 5 | | | 1, 1, 1, 2, (2) | 2p | 2 | 1, 1, 1, 2, (2) | |
| 4 | | | 1, 1, 1, (2) | 2p | 2 | 1, 1, 1, (2) | |
| 3 | | | 1, 1, (1) | 1p | 1 | 1, 1, (1) | |
| 2 | | | 1, (1) | 1p | 1 | 1, (1) | |
| 1 | | | (1) | 1p | 1 | (1) | |
| 0 | | | | 0 | 1 | | |

```
static const struct
{
    int min_bm;
    int max_bm;
} random_bm[ATA-MIN_GTA]=
{
    { 23, 25 },   // used when 1 second deducted off ATA, averages at 24
    { 26, 34 }, // used when 2 seconds deducted off ATA, averages at 30
    { 35, 45 }, // used when 3 seconds deducted off ATA, averages at 40
};
```

In the following discussion, these parameters are used further.

Natural Feature Hit Rate (NFHR) for band set 'A'=133.49276

Feature Hit Rate Time (FHRT)=NFHR×ATA=800.95 seconds

Additional Time Added (ATA)=6 seconds

Additional Time Added Cap limit (ATA_CAP)=60 seconds

The following formula was used to determine the BM when the GTA is modified by capping. This value for BM was then used for the target average value when determining the random range for BM. The BM for each user is dependant upon their Game Time Average (GTA). The BM also incorporates the number of pay-lines. However, for the purpose of this game the pay-lines are fixed at 20.

$$BM(n) = \frac{\text{PAY_Lines}(n) \times FHRT}{GTA(n) \times NFHR} \times \text{SCALING} = \frac{\text{PAY_LINES}(n) \times ATA}{GTA(n)}$$

where,

'n'—individual user id.

GTA(n)—individual user Game Time Average. (i.e. 3.3 seconds)

PAY_LINES(n)—number active pay-lines for the individual user. (i.e. 20)

NFHR—Natural Feature Hit Rate, constant based upon the reel bands. (133.49275)

FHRT—Feature Hit Rate Time, average target constant. (NFHR×ATA)

SCALING—Universal scaling constant (defined as 1 by setting FHRT=NFHR×ATA=801 seconds).

$$\text{SCALING} = \frac{ATA \times NFHR}{FHRT} = 1 \text{ for the embodiment being described}$$

where,

ATA—Additional Time Added. (i.e. 6 seconds)

Following every new game when BM is calculated, if BM has a fractional part BM is either rounded up or down based upon a chance decision determined by the fractional component. Therefore, if BM=1.6 there is a 60% chance that BM will be rounded up to 2. However, the parameters of the embodiment being described cannot result in such fractional results.

A mechanism employed that allows the embodiment being described to achieve its objectives is dynamic reel band switching, which utilizes 2 reel band sets A and B. Band set A contains a community feature entry possibility, whereas band set B has no community feature entry possibility; ie when band A is being used there is a possibility of a community feature being triggered whereas when band B is being used it is not possible. Each user has their own Feature Band Set Chance (FBSC) which governs how often band A is selected, and so how often the individual user contributes to activating the community feature. Therefore, when an individual user is playing at a much faster pace, they would normally increase their contribution to the community feature entry rate within a given average time. However, by adjusting the individual users FBSC, their contribution to the community feature entry rate can be kept constant, with their extra contribution being reflected in their increased BM instead.

$$FBSC(N) = \frac{GTA(n) \times NFHR}{\text{PLAYERS} \times FHRT} = \frac{GTA(n)}{\text{PLAYERS} \times ATA}$$

Where,

USERS—total number of eligible users in the community, ie those that have managed to set his/her eligibility flag.

Thus, in summary of the above it can be seen that the following parameters apply to the community feature:

Eligibility to the community feature bonus is governed by an 'Eligibility Timer', which is graphically depicted as a robber being chased by a cop. The Eligibility Timer typically accumulates 6 seconds per game up to a maximum of 66 seconds. The user becomes eligible when more than 6 seconds have been accumulated, which is typically on the second spin. The user remains eligible until the timer expires at zero seconds.

Community feature bonus activated by a chance event of 3, 4, or 5, scatter predetermined feature entry symbols are displayed, which simultaneously delivers a community feature to all eligible users.

Community 'Bonus Multiplier' increases from ×1 to ×20 in proportion to the Eligibility Timer, over this same region the theoretical (Return To Player) RTP from the community feature ranges from 1.2% to 24.13%

Community 'Bonus Multiplier' further increases from ×20 to ×45 in response to the Eligibility Timer being capped at around 66 seconds, due to fast game play of 3 to 5 seconds per game, the theoretical RTP from the community in this region is 24.13%.

Community stake meter records the user's stake while playing, and is used to determine awards from the community feature, in conjunction with the bonus multiplier.

Minimum average speed of play, while remaining eligible for community feature is 6 seconds per game.

Maximum speed of play is 3 seconds per game.

Maximum theoretical RTP from community feature 24.13%

Basic game and community game combined maximum theoretical RTP 95.00%.

To exemplify the above equations, if there is a single user playing at a speed where his GTA=6, his FBSC will compute to 1.0, which will result in a feature chance of 1 in 133.49275 games (NFHR).

Since the user average game speed is 6 seconds per game, the feature will occur on average every 800.95 seconds (133.49275×6)

If this single user plays at a faster rate where GTA=3, his FBSC will compute to 0.5, which will result in a feature chance of 1 in (2×133.49275) games.

Since the user average game speed is now 3 seconds per game, the feature will still occur on average every 800.95 seconds (2×133.49275×3). As such, it will be seen that although time of each game varies an award is still made such that the resultant long term average is a predetermined time period; in this embodiment 800.95 seconds.

This result shows that playing faster does not cause the feature to be triggered any sooner. However, the efforts of the user in playing at 3 seconds per game have resulted in him staking twice as many games before a feature occurs. To ensure the users feature RTP does not drop due to faster game play, the BM in this example would be doubled.

When more users join the community the FBSC is adjusted to take account of this, such that the community feature trigger rate still remains constant at 800.95 seconds.

Therefore, 2 users playing at GTA=6, produces an FBSC=0.5, which can be added together to give 1.0

However, when 1 user has a GTA=6, and another user has a GTA=3, there respective FBSC is 0.5 and 0.25. However, you need to add 0.25 twice since this chance is occurring twice as often as the 0.5 chance, since this user is playing twice as fast, hence $0.5+(0.25\times2)=1$ From my above explanation it can be seen that there is a constant average rate at which the community feature occurs of every 800.95 seconds.

For each game played the FBSC and BM for that game are a function of GTA, and in the case of FBSC also the number of users. In the real game GTA is always equal to 6, unless ET is capped.

Therefore;

GTA=ATA−capped seconds from ET, where ATA=6

If it is assumed that the user plays at various speeds of play, and as a consequence his/her Eligibility Timer (ET) increases and decreases (represented by the robber moving to the left and right), but never attempts to push ET beyond it's limit so never causes ET to be capped, the user will have a Game Time Average of exactly 6 seconds when his ET finally expires. In conclusion if the user was actual playing at a rate of 3 seconds per game so producing a GTA of 3 seconds (assuming that capping did not occur) then GTA of twice this figure is used to allow for the future benefit the user would incur when he stops playing while ET takes time to expire. When the user stops playing he remains eligible for any community features while his ET has not expired.

When ET is capped there are momentary changes to GTA, which adjust FBSC and BM for the duration of that game, which balances everything out so there is no loss or gain in RTP.

The community feature which is accessed when the predetermined feature entry symbols are displayed may any number of suitable games. However, in one embodiment the following is provided.

The user is presented with a large safe on screen. The safe is blown and a single multiplier win is displayed.

Any reference to player may be interpreted as referring to a user and visa versa.

What is claimed is:

1. A community award distribution system, comprising:

a community of terminals, in which each of the terminals comprises a display that is configured to present an award scheme, the community of terminals including a first terminal and a second terminal; and a server arranged to communicate over a network with the community of terminals and provide the award scheme that includes a community award to be distributed between users of the community of terminals, wherein the server is configured to:

(a) when contacted by the first terminal, respond by downloading content to the first terminal to provide the first terminal with content for the community award distribution system, (b) when a user of the first terminal uses the content for the community award distribution system to play a game on the first terminal:

(i) receive a time stamped data packet from the first terminal, (ii) determine whether to trigger a community game feature for the user by:

(A) determining whether an eligibility timer for the user indicates that the user is eligible for the community award, (B) determining that the user who is a first eligible user or another one of said users who is a second eligible user has achieved a predetermined result in the game, and (C) if the eligibility timer for the user indicates that the user is eligible for the community award and the first or second eligible user has achieved the predetermined result, triggering the community game feature, otherwise causing the first terminal to play the game without the community game feature, and (iii) return a reply data packet to the first terminal that contains a first indication of whether or not the game has resulted in a win, and a second indication of whether the community game feature has been triggered, (c) increment the eligibility timer each time that the user plays a new instance of the game and subsequently decrement the eligibility timer with the passage of time in each instance of the game, (d) cause the user to become eligible for the community award when the eligibility timer exceeds a threshold and remains eligible for the community award until the eligibility timer runs down to zero, (e) determine a game time average (GTA) for the user, (f) determine a number of users who are eligible for the community award, (g) determine an additional time added (ATA) value, (h) determine a Feature Band Set Chance (FBSC) for the user of the first terminal based on the GTA, the number of users who are eligible for the community award, and the ATA value, and (i) dynamically switch between a first reel band set containing a community feature award entry possibility and a second reel band set containing no community feature award entry possibility, wherein how often the server switches to the first reel band set is based on the FBSC for the user of the first terminal.

2. A community award distribution system according to claim 1, wherein the server (a) comprises a timer arranged to monitor time and (b) is configured to ensure that a long term resultant average time between community awards corresponds to a predetermined time period.

3. A community award distribution system according to claim 2, wherein the system is arranged such that the number of users does not affect the predetermined time period.

4. A community award distribution system according to claim 1, wherein:

the game comprises a plurality of reels, each of which contains a distinct set of symbols thereon;

the predetermined result comprises a predetermined feature reel combination; and the reply data packet also comprises data indicating reel positions to which reels on the display of the terminal should be moved.

5. A community award distribution system according to claim 1, wherein the eligibility timer is used to help determine the community award.

6. A community award distribution system according to claim 1, wherein each terminal of the community of terminals is configured so that, when a user of any of the terminals plays a new game, that user's terminal will send the time stamped data packet to the server, indicating when the start of that game occurred.

7. A community award distribution system according to claim 1, wherein the reply data packet also contains at least one of the following:

a position to which an award determining mechanism selected by the server for the user of the terminal should be moved; or a status of a credit of the user.

8. A community award distribution system according to claim 1, wherein the first terminal is also arranged to interrogate the server from time to time to check if a community feature is pending.

9. A community award distribution system according to claim 8, wherein the interrogation of the server only occurs following inactivity from the user.

10. A community award distribution system according to claim 1, each of the first and second set of reel band set includes a set of reels presenting a unique set of symbols, wherein the server is arranged to control a long term resultant average time between community awards.

11. A community award distribution system according to claim 1, wherein the community award may be activated by any eligible user of the community of terminals and wherein a first award determining mechanism is used to determine if a first eligible user activates the community award at a first time and a second award determining mechanism is used to determine if a second eligible user activates the community award at the first time.

12. A community award distribution system according to claim 1, wherein the first terminal is configured to graphically depict the eligibility timer on the display.

13. A method of providing a community award, comprising:

providing a server which communicates over a network with a community of terminals including a first terminal and a second terminal and provides an award scheme which pays the community award distributed between users of the community of terminals, wherein the server is configured to:

(a) when contacted by a first terminal, respond by downloading content to the first terminal to provide the first terminal with content for a community award distribution system, (b) when a user of the first terminal uses the community award distribution system to play a game on the first terminal:

(i) receive a time stamped data packet from the first terminal, (ii) determine whether to trigger a community game feature for the user by:

(A) determining whether an eligibility timer for the user indicates that the user is eligible for the community award, (B) determining that the user, who is a first eligible user, or a second eligible user of a second terminal of the community of terminals has achieved a predetermined result in the game, and (C) if the eligibility timer for the user indicates that the user is eligible for the community award and the first or second eligible user has achieved the predetermined result, triggering the community game feature, otherwise causing the first terminal to play the game without the community game feature, and (iii) return a reply data packet to the first terminal that contains a first indication of whether or not the game has resulted in a win, and a second indication of whether the community game feature has been triggered, (c) determine a game time average (GTA) for the user, (d) determine a number of users who are eligible for the community award, (e) determine an additional time added (ATA) value, (f) determine a Feature Band Set Chance (FBSC) for the user of the first terminal based on the GTA for the user, the number of users who are eligible for the community award, and the ATA value, (g) dynamically switch between a first reel band set containing a community feature award entry possibility and a second reel band set containing no community feature award entry possibility, wherein how often the server switches to the first reel band set is based on the FBSC for the user of the first terminal, (h) increment the eligibility timer each time that the user plays a new instance of the game and subsequently decrement the eligibility timer with the passage of time in each instance of the game, and (i) cause the user to become eligible for the community award when the eligibility timer exceeds a threshold and remains eligible for the community award until the eligibility timer runs down to zero.

14. A server, comprising:

a processing unit;

an input/output subsystem that communicates with a community of terminals over a network;

an eligibility timer; and a non-transitory memory containing instructions that are configured to cause the processing unit to:

(a) output a plurality of award determining mechanisms which are used to determine whether a community award can be entered into and triggered by users of the community of terminals, (b) receive a communication from a first terminal of the community of terminals indicating that a game has been started on the first terminal, wherein the communication comprises a time stamped data packet, (c) determine whether to trigger a community game feature for a user of the first terminal by:

(A) determining whether an eligibility timer for the user of the first terminal indicates that the user is eligible for the community award, (B) determining that the user, who is a first eligible user, or a second eligible user has achieved a predetermined result in the game, and (C) if the eligibility timer for the user of that terminal indicates that the user is eligible for the community award and the first or second eligible user has achieved the predetermined result, triggering the community game feature, otherwise causing that terminal to play the game without the community game feature, and respond with a reply data packet indicating the outcome of that game, (d) increment the eligibility timer each time that the user plays a new instance of the game and subsequently decrement the eligibility timer with the passage of time in each instance of the game, (e) cause the user to become eligible for the community award when the eligibility timer exceeds a threshold and remains eligible for the community award until the eligibility timer runs down to zero, (f) determine a game time average (GTA) for the user of the first terminal, (g) determine a number of users who are eligible for the community award, (h) determine an additional time added (ATA) value, (i) determine a Feature Band Set Chance (FBSC) for the user of the first terminal based on the GTA for the user, the number of users who are eligible for the community award, and the ATA value, and (j) dynamically switch between a first reel band set containing a community feature award entry possibility and a second reel band set containing no community feature award entry possibility, wherein how often the server switches to the first reel band set is based on the FBSC for the user of the first terminal.

15. A server according to claim 14, wherein the server is further arranged to control the award determining mechanisms in order that a community award is paid to the community of terminals at, on average, a predetermined fixed period.

16. A non-transitory machine readable medium containing instructions which when loaded onto a server cause that server to:

when contacted by a first terminal of a community of terminals, respond by downloading content to the first terminal to provide the first terminal with content for a community award distribution system; and when a user of the first terminal uses the community award distribution system to play a game on the first terminal:

(a) receive a time stamped data packet from the first terminal;

(b) determine whether to trigger a community game feature for the user by:

(A) determining whether an eligibility timer for the user indicates that the user is eligible for the community award, (B) determining that the user, who is a first eligible user, or a second eligible user has achieved a predetermined result in the game, and (C) if the eligibility timer for the user indicates that the user is eligible for the community award and the first or second eligible user has achieved the predetermined result, triggering the community game feature, otherwise causing the first terminal to play the game without the community game feature;

(c) return a reply data packet to the first terminal that contains a first indication of whether or not the game has resulted in a win, and a second indication of whether the community game feature has been triggered;

(d) determine a game time average (GTA) for the user;

(e) determine a number of users who are eligible for the community award;

(f) determine an additional time added (ATA) value;

(g) determine a Feature Band Set Chance (FBSC) for the user of the first terminal, based on the GTA for the user, the number of users who are eligible for the community award, and the ATA value; and (h) dynamically switch between a first reel band set containing a community feature award entry possibility and a second reel band set containing no community feature award entry possibility, wherein how often the server switches to the first reel band set is based on the FBSC for the user of the first terminal;

(i) increment the eligibility timer each time that the user plays a new instance of the game and subsequently decrement the eligibility timer with the passage of time in each instance of the game; and (j) cause the user to become eligible for the community award when the eligibility timer exceeds a threshold and remains eligible for the community award until the eligibility timer runs down to zero.

* * * * *